United States Patent [19]

Schoonman

[11] 3,942,588

[45] Mar. 9, 1976

[54] COOLING TOWER

[75] Inventor: Willem Schoonman, Wyckoff, N.J.

[73] Assignee: The Lummus Company, Bloomfield, N.J.

[22] Filed: Nov. 4, 1974

[21] Appl. No.: 520,790

[52] U.S. Cl. ..... 165/129; 261/DIG. 11; 165/125

[51] Int. Cl.[2] ..... F28F 13/00

[58] Field of Search ..... 165/110, 111, 122, 129, 165/47; 261/DIG. 11

[56] References Cited

UNITED STATES PATENTS

| | | | |
|---|---|---|---|
| 3,400,917 | 9/1968 | Richards | 165/129 |
| 3,422,883 | 1/1969 | Daltry | 261/DIG. 11 X |
| 3,519,068 | 7/1970 | Harris et al. | 165/122 |
| 3,764,121 | 10/1973 | Fordyce | 261/DIG. 11 |
| 3,844,344 | 10/1974 | Kliemann et al. | 165/129 |

FOREIGN PATENTS OR APPLICATIONS

| | | | |
|---|---|---|---|
| 1,027,698 | 4/1958 | Germany | 165/122 |

*Primary Examiner*—Charles J. Myhre
*Assistant Examiner*—Theophil W. Streule, Jr.
*Attorney, Agent, or Firm*—Marn & Jangarathis

[57] ABSTRACT

A cooling tower with a plurality of radially extending circumferentially spaced tubular heat exchanger units having their heat exchanger surfaces in vertical planes, preferably upwardly and outwardly inclined vertical planes, with the radial outer end of each unit having a greater width (in the vertical direction) than the radial inner end of each unit.

5 Claims, 7 Drawing Figures

FIG. 1
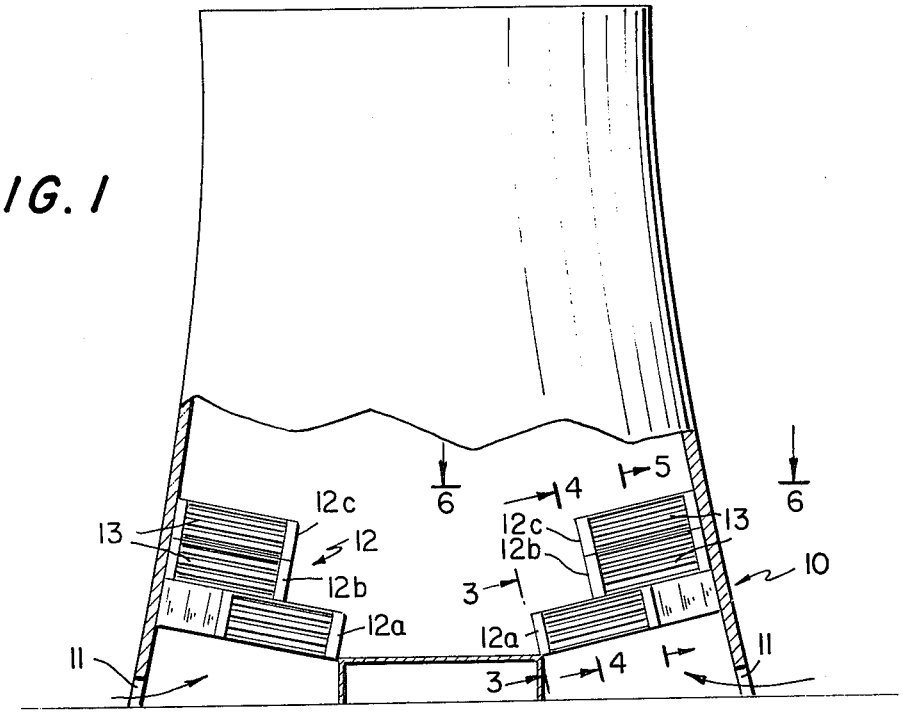
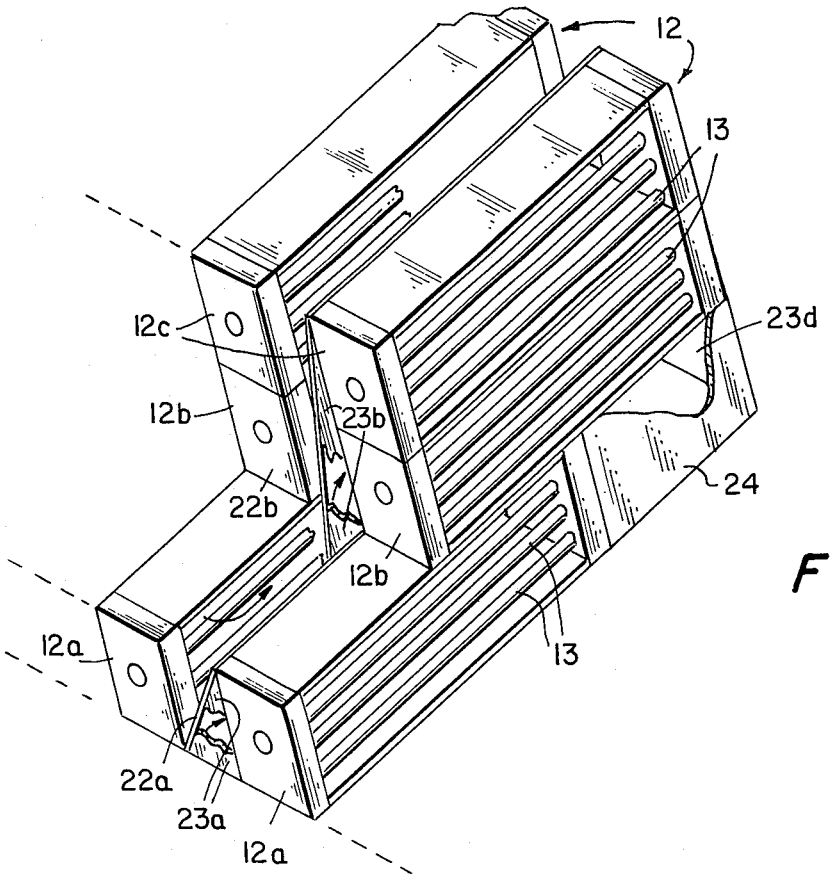
FIG. 2

FIG. 3
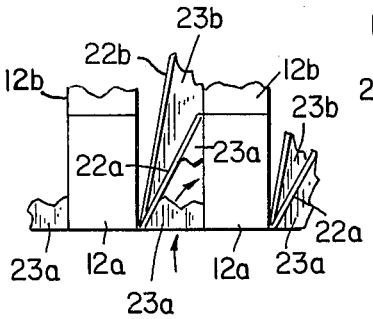
FIG. 4
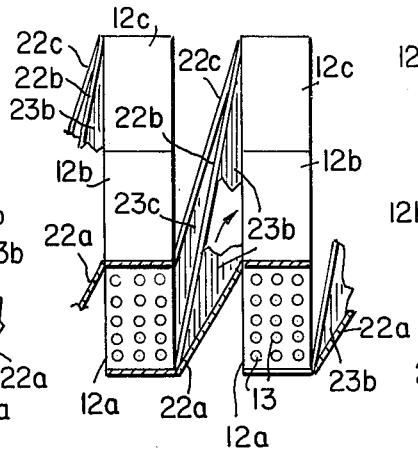
FIG. 5
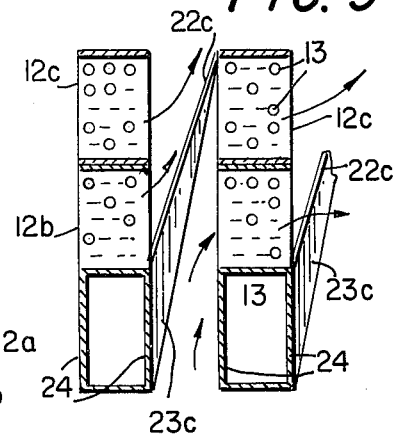
FIG. 6
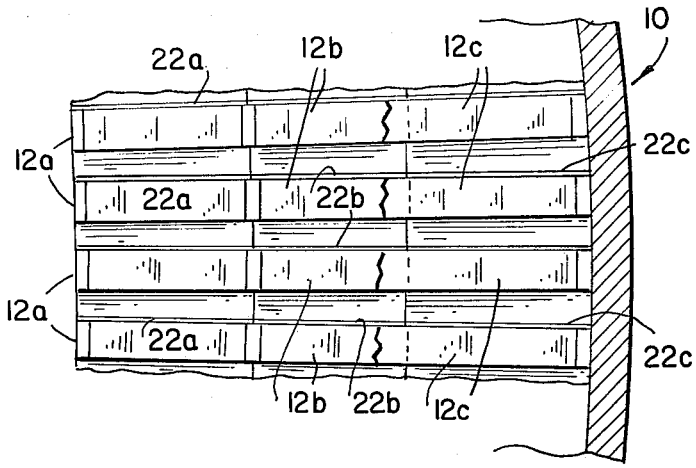
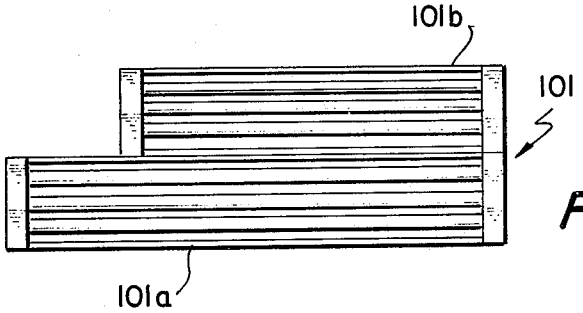
FIG. 7

COOLING TOWER

The present invention relates to cooling towers, and more particularly to cooling towers in which tubular heat exchangers are arranged in a tower, and fluid passed through the tubes of the exchanger is cooled by indirect heat transfer with air which enters the tower and flows through the heat exchangers in indirect heat transfer relationship with fluid in the tubes.

In accordance with the present invention, there is provided a hollow cooling tower which includes a plurality of radially extending circumferentially spaced heat exchanger units having their heat exchanger surfaces extending in a vertical plane, preferably in an upwardly and outwardly extending inclined vertical plane. Each heat exchanger unit is constructed in a manner such that its outer end has a greater width, in the vertical direction, than its inner end. Suitable air directing means are provided in the spaces between the heat exchanger units to insure that air which enters the tower flows through the heat exchanger units.

The invention will be further described with respect to embodiments thereof illustrated in the accompanying drawings, wherein:

FIG. 1 is a sectional view of an embodiment of the cooling tower of the present invention;

FIG. 2 is an isometric view of the heat exchanger arrangement of the embodiment of FIG. 1;

FIG. 3 is a sectional view along 3—3 of FIG. 1;

FIG. 4 is a sectional view along line 4—4 of FIG. 1;

FIG. 5 is a sectional view along line 5—5 of FIG. 1;

FIG. 6 is a partial sectional view along line 6—6 of FIG. 1; and

FIG. 7 is a simplified schematic representation of an alternative heat exchanger arrangement.

Referring to the drawings, there is shown a hollow cooling tower in the form of a natural draft hyperbolic cooling tower 10, having inlets 11 through which cooling air flows, by natural draft, from the surrounding atmosphere. It is to be understood that the tower could be of the forced air type or could be a natural draft tower with a shape other than hyperbolic.

The lower interior of the cooling tower 10 is provided with a plurality of heat exchanger means in the form of a plurality of circumferentially spaced tubular heat exchanger units 12, which extend in the radial direction, and are positioned in an upwardly and outwardly inclined vertical plane, to provide a vertical extending heat exchanger surface, whereby air flow through the exchanger units 12 is primarily in a horizontal direction. Alternatively, and less preferred, the heat exchanger units can be positioned in non-inclined vertical planes.

Each of the heat exchanger units 12 is comprised of two or more tubular heat exchangers, 12*a*, 12*b*, etc. having tube bundles, comprised of a plurality of exposed parallel tubes 13, which are provided with fluid to be cooled through suitable inlet and outlet headers. The fluid can be a gas such as steam or a liquid, such as water and cooling could be effected for condensing steam. The tubes 13 may include fins or the like to increase heat transfer, and fluid flow through the tubes may be upward or downward, as known in the art.

In accordance with the present invention, the individual heat exchangers of each heat exchanger unit 12 are arranged in a manner such that the radial outer end of each unit has a greater width (in the vertical direction) than the radial inner end of each unit.

As particularly shown in FIGS. 1–6, such a result is achieved by each heat exchanger unit 12 being comprised of three heat exchangers 12*a*, 12*b* and 12*c*, of equal length, with the outer end of the unit being comprised of superimposed heat exchangers 12*b* and 12*c* to define an outer end heat exchanger sub-unit, having a two heat exchanger width and the inner end of each unit being comprised of a heat exchanger 12*a*, to define an inner end heat exchanger sub-unit having a single heat exchanger width. As shown, the sub-units overlap each other, but as should be apparent, such a result could also be achieved without overlapping of the sub-units. Each of the individual heat exchangers 12*a*, 12*b*, 12*c*, etc. can have a tube thickness of one, two or more tubes.

The heat exchanger units are further provided with air directing means 21 in the form of inclined plates or sheets 22*a*, 22*b*, and 22*c* for insuring that air which flows into the tower 10 flows through the heat exchanger units. As particularly shown, the plates or sheets are arranged in the spaces between the individual heat exchanger units 12 in a manner such that each plate or sheet extends from the bottom of one heat exchanger unit 12 to the top of the next adjacent unit over the length thereof, to direct air which flows from the bottom of the tower, into the space between adjacent heat exchange units 12, through the heat exchanger units 12 which has the air directing plate or sheets attached to the top thereof. As particularly shown in FIGS. 2, 3, 4, and 5 for the heat exchanger arrangement of FIGS. 1–6, the air directing means is comprised of three different plates or sheets 22*a*, 22*b* and 22*c*, to provide for the varying heat exchanger unit widths (in the vertical direction) over the length of unit 12, with the inner end having a single exchanger width, an intermediate portion, a three exchanger width, and the outer end a two exchanger width. As particularly shown, plate 22*a* has a length equal to the length of the single exchanger width of a unit 12 and extends in an upwardly inclined horizontal plane from the bottom of one heat exchanger unit 12*a* to the top of heat exchanger 12*a* of the next adjacent heat exchanger unit 12. Similarly, plate 22*b* has a length equal to the length of the three exchanger width of unit 12 and extends in an upwardly inclined horizontal plane from the bottom of heat exchanger 12a to the top of heat exchanger 12*c* of the next adjacent unit 12. Similarly, plate 22*c* has a length equal to the length of the two heat exchanger width of unit 12 and extends in an upwardly inclined horizontal plane from the bottom of heat exchanger 12*b* to the top of heat exchanger 12*c* of the next adjacent unit 12.

The air directing means further includes triangular vertical plates or sheets 23*a*, 23*b*, 23*c* and 23*d* which are positioned to seal the vertical spaces at the ends of the air directing sheets 22*a*, 22*b* and 22*c*. Further air seals or plates 24, as required, are provided at the under sides of heat exchangers 12*b* to prevent air which enters the tower from passing through the tower without passing through the heat exchanger units 12.

In operation, air which enters the bottom of tower 10 flows upwardly into the space between heat exchanger units 12, and is directed by the air seals or plates 22*a*, 22*b*, 22*c* horizontally through heat exchangers 12*a*, 12*b* and 12*c*, wherein the air cools fluid flowing through the tubes by indirect heat transfer. The air which exits from the heat exchanger units 12 flows vertically upwardly through the tower and out the top thereof.

It is to be understood that within the spirit and scope of the present invention, it is possible to effect modification of the hereinabove described embodiment. Thus, for example, although the embodiment has been described with respect to the use of three heat exchangers in each unit, more than three exchangers could be employed and there can be more than two sub-units. Thus, for example, each unit can be comprised, in the radial outward direction, of an inner sub-unit of one exchanger width, a further sub-unit of two exchanger widths, another sub-unit of three exchanger widths, etc.

Similarly, each unit can be comprised of two exchangers, positioned in an end to end relationship with the outer unit having a greater width, in the vertical direction, than the inner unit.

As another alternative, as shown in FIG. 7, each heat exchanger unit 101 can be comprised of two exchangers, with the first exchanger 101*a* extending over the full radial length of the tower, and the second exchanger 101*b* positioned in a side to side relationship with the first exchanger over the outer radial portion to provide an overall unit with a greater width at its outer end.

The above modifications and others should be apparent to those skilled in the art from the teachings herein.

Numerous modifications and variations of the present invention are possible in light of the above teachings, and, therefore, within the scope of the appended claims, the invention may be practiced otherwise than as particularly described.

What is claimed is:

1. A cooling tower, comprising:

a hollow tower; a plurality of radially extending tubular heat exchanger units circumferentially spaced within the lower portion of the tower, said heat exchanger units having their heat exchanger surfaces extending in an inclined vertical plane, each of said heat exchanger units having a radial inner end and a radial outer end, the width in the vertical direction of the radial outer end being greater than the width, in the vertical direction, of the radial inner end, each of said heat exchanger units comprising first, second and third heat exchangers, the first heat exchanger comprising the radial inner end of the heat exchanger unit, said second and third heat exchangers being superimposed one on top of the other with the heat exchanger surfaces in a vertical plane, said superimposed second and third heat exchangers comprising the radial outer end of said heat exchanger unit; and air directing means for directing air which enters the tower through the heat exchanger units.

2. The cooling tower of claim 1 wherein the air directing means comprises impermeable plates positioned in the spaces between adjacent heat exchanger units, said plates being positioned in an inclined horizontal plane, said plates extending from the bottom of a heat exchanger unit to the top of the next adjacent heat exchanger unit over the length of the heat exchanger unit.

3. The cooling tower of claim 1 wherein the air directing means comprises first, second and third impermeable plates positioned in inclined horizontal planes in the spaces between the heat exchanger units over the length of the heat exchanger units, said first plate extending from the bottom of the first heat exchanger to the top of the adjacent first heat exchanger at the radial inner end of said heat exchanger unit, said second plate extending from the bottom of the first heat exchanger to the top of the adjacent third heat exchanger over the portion of the heat exchanger unit wherein the superimposed second and third heat exchangers overlap the first heat exchanger, and the third plate extending from the bottom of the second heat exchanger to the top of the adjacent third heat exchanger at the radial outer end of the heat exchanger unit.

4. The cooling tower of claim 1 wherein the superimposed second and third heat exchangers are positioned in an overlapping relationship with the first heat exchanger.

5. The cooling tower of claim 1 wherein the superimposed second and third heat exchangers are positioned in an end to end relationship with the first heat exchanger.

* * * * *